US008051984B1

(12) United States Patent
Johnston et al.

(10) Patent No.: US 8,051,984 B1
(45) Date of Patent: Nov. 8, 2011

(54) WINDOWED SEED PACK ENVELOPE WITH WRAP AROUND WINDOW

(75) Inventors: Robert H. Johnston, Columbus, OH (US); Marcus Sheanshang, Lebanon, OH (US)

(73) Assignee: Livingston Seed, Inc., Columbus, OH (US)

( * ) Notice: Subject to any disclaimer, the term of this patent is extended or adjusted under 35 U.S.C. 154(b) by 0 days.

(21) Appl. No.: 12/839,466

(22) Filed: Jul. 20, 2010

(51) Int. Cl.
*B65D 25/54* (2006.01)

(52) U.S. Cl. ..... 206/778; 229/75; 229/71

(58) Field of Classification Search ..... 206/776–779; 229/75, 68.1, 71, 162.1, 162.4, 162.7
See application file for complete search history.

(56) References Cited

U.S. PATENT DOCUMENTS

| | | | | | |
|---|---|---|---|---|---|
| 696,985 | A | | 4/1902 | Lucas | |
| 1,264,451 | A | | 4/1918 | Swift | |
| 1,387,717 | A | | 8/1921 | Hogan | |
| 1,978,396 | A | * | 10/1934 | Ardavanis et al. | 229/162.7 |
| 2,087,879 | A | | 7/1937 | Andrews | |
| 2,200,099 | A | | 5/1940 | Prentice | |
| 2,712,382 | A | * | 7/1955 | Clarke | 229/162.7 |
| 2,945,617 | A | * | 7/1960 | Normandin | 229/67.3 |
| 3,038,650 | A | * | 6/1962 | Asman | 229/162.7 |
| 3,158,313 | A | | 11/1964 | Hubbard | |
| 3,199,670 | A | * | 8/1965 | Palmer | 229/162.4 |
| 3,337,032 | A | * | 8/1967 | Ebelhardt | 229/162.7 |
| 3,835,988 | A | | 9/1974 | Buttery | |
| 5,400,954 | A | | 3/1995 | Kaye | |
| 6,523,737 | B1 | | 2/2003 | Flynn et al. | |
| D471,229 | S | | 3/2003 | DeFranco | |
| 6,709,018 | B2 | | 3/2004 | Phillips | |
| 6,758,341 | B1 | | 7/2004 | Johnston | |
| 6,866,184 | B2 | | 3/2005 | Wood | |
| 2003/0085261 | A1 | | 5/2003 | Wierer et al. | |
| 2003/0141352 | A1 | | 7/2003 | Smith et al. | |
| 2004/0256444 | A1 | | 12/2004 | Becker | |
| 2006/0219762 | A1 | | 10/2006 | Pierce et al. | |

* cited by examiner

*Primary Examiner* — J. Gregory Pickett
*Assistant Examiner* — Andrew Perreault
(74) *Attorney, Agent, or Firm* — Frank H. Foster; Kremblas & Foster

(57) ABSTRACT

A seed envelope having a window formed with an aperture extending not only through and entirely across the front panel of the envelope from one side edge to the laterally opposite side edge but also further extending beyond the side edges and onto the back of the envelope. A transparent sheet of window material extends beyond the aperture so as to overlap the sheet of envelope material in a peripheral overlap area around the aperture. The transparent sheet is folded along the laterally opposite side edges and bonded to the front panel and envelope panels connected to the sides of the front panel. Preferably, the aperture also extends beyond the bottom fold crease and into the panel that is connected to the bottom of the front panel and is folded onto the back of the envelope. The seed content is visible from the sides of the envelope and even the rear of the envelope adjacent its side and bottom edges. The bottom corners are strengthened by gussets and by downward extensions of the laterally opposite side panels.

6 Claims, 4 Drawing Sheets

Fig. 2
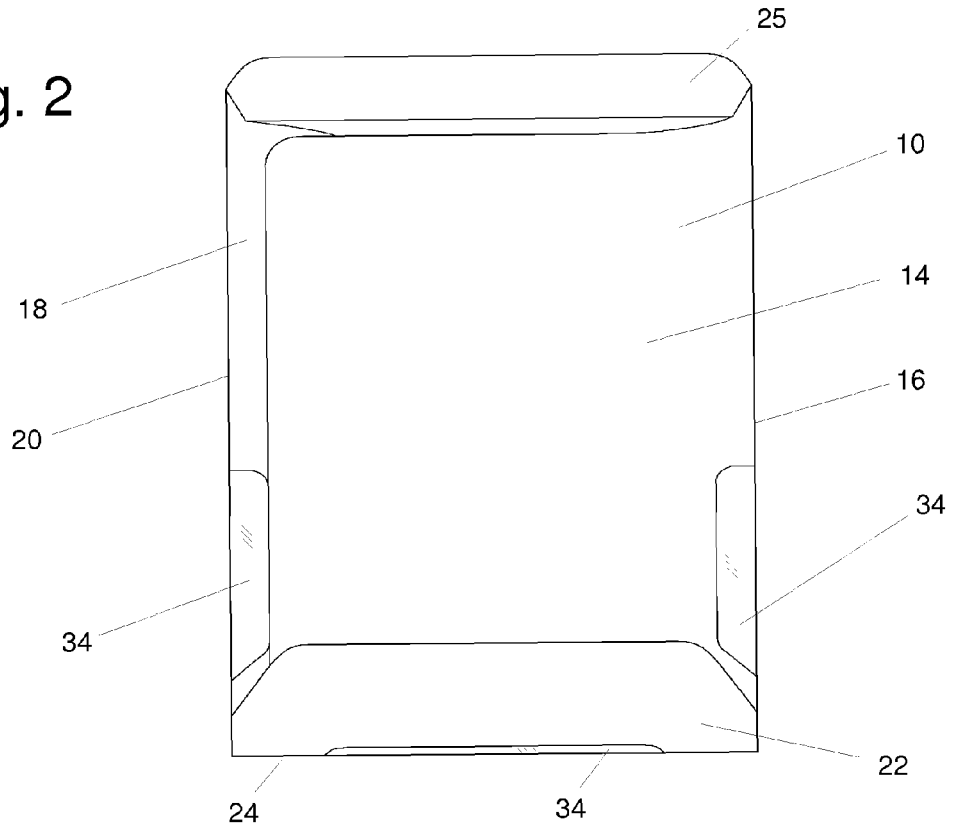
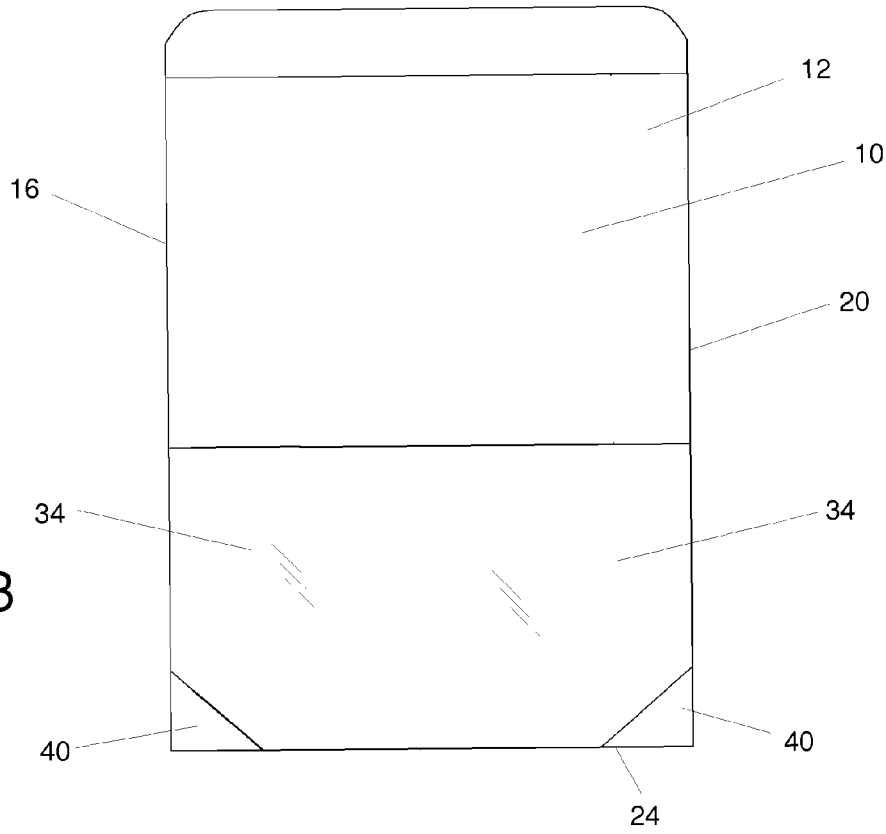
Fig. 3

Fig. 4
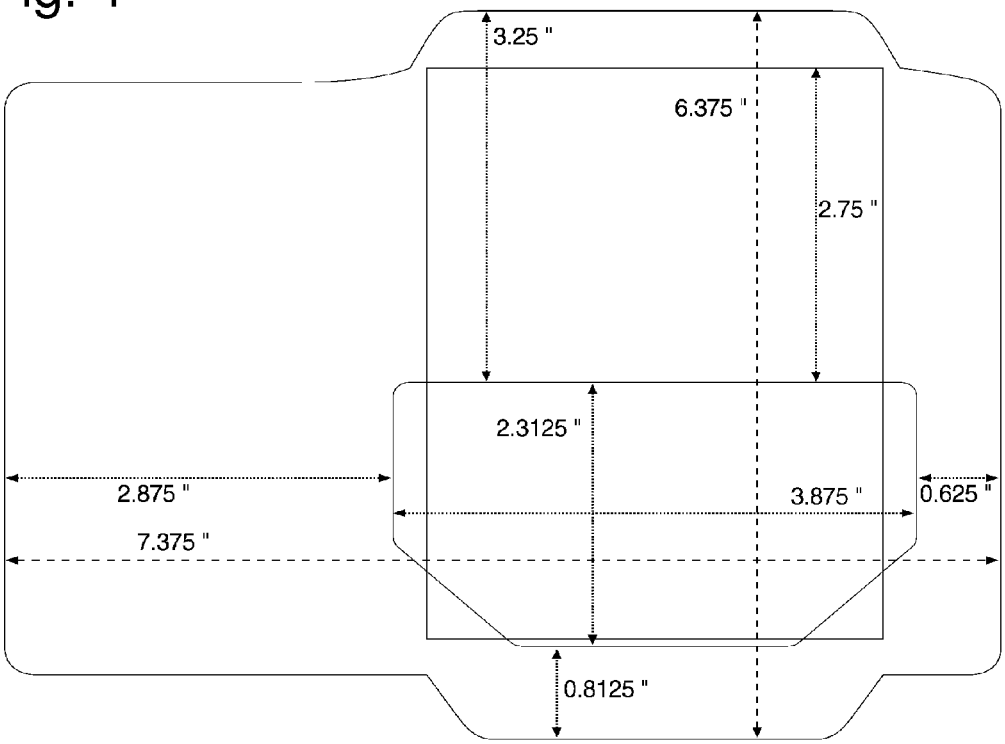
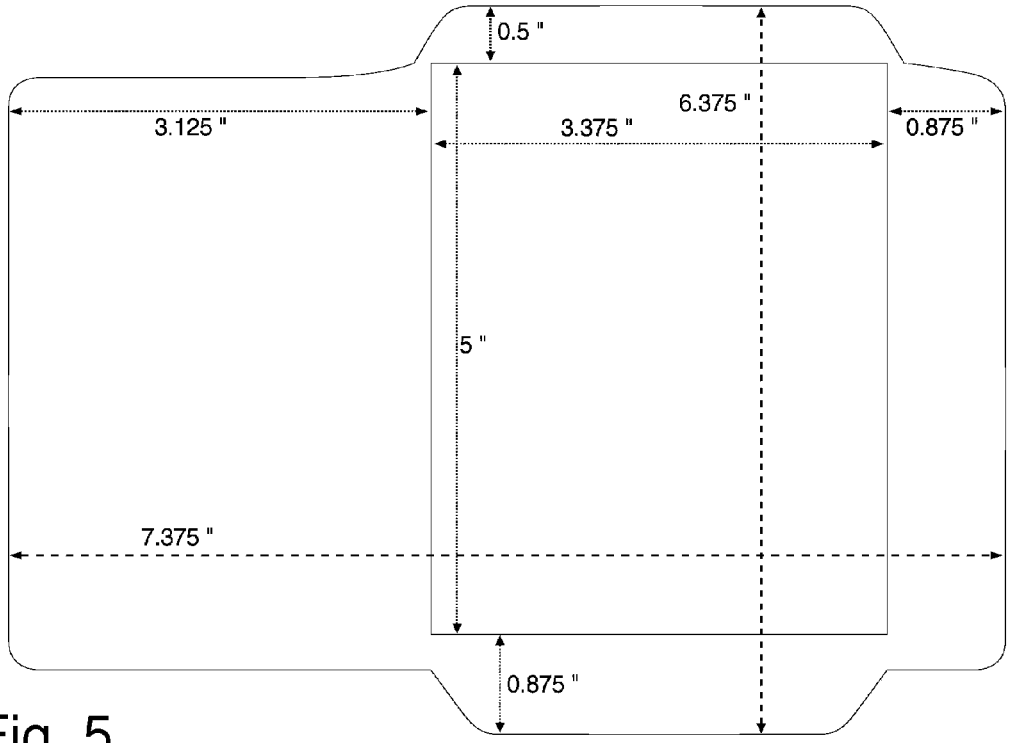
Fig. 5

Fig. 6
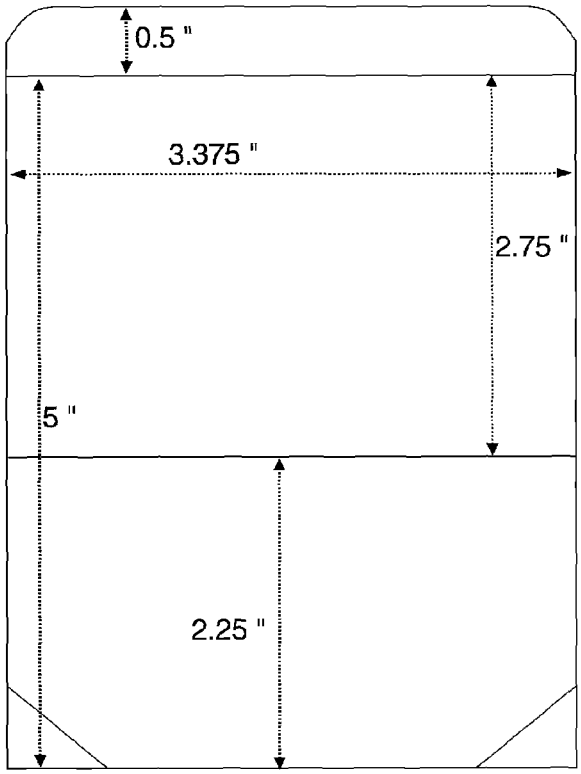
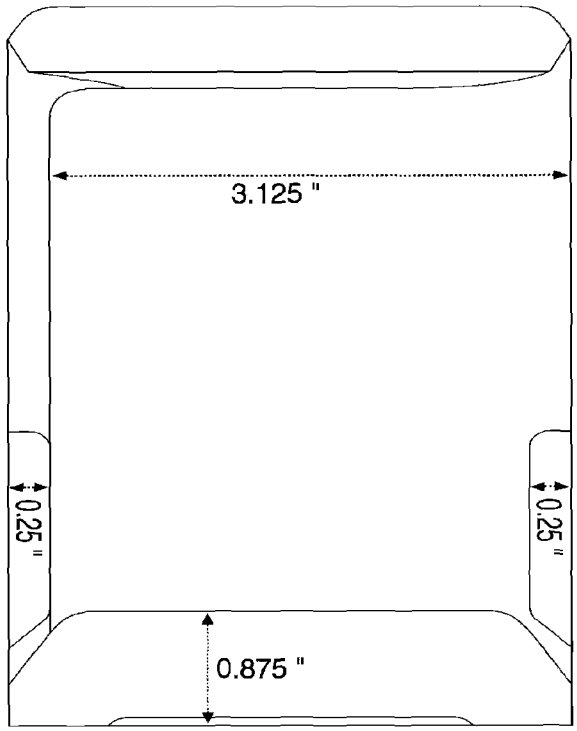
Fig. 7

WINDOWED SEED PACK ENVELOPE WITH WRAP AROUND WINDOW

BACKGROUND OF THE INVENTION

This invention relates to the field of envelopes and more particularly to envelopes having a window through which the contents of the envelope can be viewed and most particularly to envelopes for the retail display and sale of garden and landscaping seed.

Seeds packaged for the home or retail market have long been displayed by retailers in racks having an array of envelopes containing available seeds for a variety of plants. Initially, such seed packs were made entirely of paper and eventually colored pictures of the associated plants were printed on the front of the paper envelopes so the consumer could see the plant that would develop from the seeds contained in the seed pack. A later development was the use of a window in the front panel of the seed envelope to allow a customer to view some of the contained seed. Windows are commonly formed in envelopes by forming an aperture in the sheet of paper or other envelope material and then bonding a sheet of transparent window material across the aperture. The transparent window material extends beyond the boundaries of the aperture so it overlaps onto the paper and is bonded to the paper sheet along at least a portion of the overlap. This forms a window through the aperture.

Paper remains a desirable sheet material for forming the principal part of a seed envelope because paper is strong and durable, inexpensive and provides a surface that readily accepts the printing of quality pictures. A crease formed at a fold in paper is also relatively stiff or rigid thereby helping to maintain the envelope in a straight, non-sagging upright position. Windows too remain a desirable feature of seed envelopes. However, seed envelopes and envelopes generally have been limited to windows that are relatively small. Most prior art envelope windows extend over only a portion of one of the panels forming the envelope, usually the front panel. Such a window is suitable for most envelope uses because most envelopes are made to contain folded paper sheets or other flat objects and the windows are not intended to reveal the entire contents of the envelope. Most envelope windows are intended to reveal an address, a symbol or brief message or merely that there is something in the envelope. There have also been envelopes with narrow windows that extend around an edge of an envelope.

It would be desirable for a seed envelope to have a window that allows viewing of the entire seed contents of the envelope. Such improved visibility would permit a consumer to view all the seed in order to see the quantity of seed in the envelope and to verify its quality. It would be particularly desirable to have a window that even allowed viewing from the side and back of the envelope because that would give prospective purchasers an even better perspective on the quantity and quality of the seeds.

One difficulty that is encountered in designing a windowed seed envelope arises because seeds are particles that behave like a fluid because they flow somewhat like a liquid. As a result of this fluid characteristic, a quantity of seed filled into an envelope tends to apply distributed forces against the front, back, sides and bottom of the envelope. These forces cause the front and back panels of the envelope to spread, separate and move apart like the walls of a sack. The distance of separation is typically ⅛" to ½" depending on seed size and weight. As a result, the fold creases and especially the corners of the envelope are stressed by the seed contents considerably more than the minimal stress caused by insertion of a flat object into an envelope. Because of these stresses, it is common for seed envelopes to tear and for seeds to leak from a seed envelope. The inclusion of a relatively large window in a seed envelope, especially a window that extends to the edges of the envelope, creates additional opportunities for weak areas that would be subject to being torn by the stress applied by the contained seed. Because it is desirable to have a seed envelope that is a composite that is formed principally of paper but has a transparent window material that is a plastic material, and because the formation of a window aperture in the paper reduces the strength of the envelope in some areas of the envelope, the size of windows in seed envelopes has been limited.

Therefore, it is an object and feature of the invention to provide a seed envelope that has a greatly enlarged window and yet has the strength to retain its seed contents.

Another object and feature of the invention is to provide a seed envelope with a window that extends beyond both the side edges onto the back of the envelope and to the bottom edge of the envelope and preferably beyond the bottom edge onto the back of the envelope and yet have the strength to retain seed particulates despite the wrap around windows. This feature allows not only viewing of the seed contents from the front and rear of the envelope but also allows viewing of the seed contents from the side as a result of the spreading of the front panel from the back panel of the envelope in response to the fluid forces applied by the seed contents.

BRIEF SUMMARY OF THE INVENTION

The invention is an improvement in prior art seed envelopes that have been formed from a sheet of envelope material that has a front panel and side panels connected to the front panel along the creased, side edges of the front panel. The three side panels are folded against the front panel and adhered together to form the back of the envelope. The improvement of the invention has a window aperture extending through and entirely across the front panel from one of the laterally opposite creased side edges to the other laterally opposite creased side edge and further extends beyond the laterally opposite creased edges and into the side panels that are connected to the front panel along laterally opposite creased edges. A transparent sheet of window material extends beyond the aperture so as to overlap the sheet of envelope material in the peripheral overlap area around the aperture. The transparent sheet has a width greater than the distance between the laterally opposite side edges and is folded along the laterally opposite side edges. The transparent sheet is bonded to at least the front panel and the panels that are connected to the front panel along the laterally opposite fold creases at the peripheral overlap area.

The invention is further improved by extending the aperture at least to the fold crease along a bottom of the envelope. The transparent sheet is folded along the bottom fold crease and bonded to the side panel that is connected to the front panel along the bottom edge of the front panel. Preferably, the aperture extends beyond the bottom fold crease and into the panel that is connected to the front panel along the bottom fold crease so that a portion of the contents of the envelope is visible from the back of the envelope adjacent the bottom fold crease.

In order to strengthen the corners of the envelope, the aperture preferably has gussets formed in the sheet of envelope material at the opposite ends of the bottom fold crease. The gussets extend across a portion of the front panel at bottom corners of the envelope and beyond the laterally opposite side edges onto laterally opposite sides of the aperture.

The term "gusset" is used to refer to a reinforcing structural component similar to a gusset in sewing or mechanical engineering. A gusset, most commonly triangular, provides additional strength at the junction of two structures, in this case the junction of two sides of the aperture. In the invention, the gusset is preferably formed unitarily with the envelope material and not as a separate sheet.

In order to further strengthen the corners of the envelope, the panels, that are connected to the front panel along the laterally opposite side edges, have a lower portion extending beyond the bottom fold crease and are integrally connected to the bottom panel that is connected to the front panel along the bottom fold crease so that a lower portion of all three panels that are connected to the front panel are folded along the bottom fold crease.

BRIEF DESCRIPTION OF THE SEVERAL VIEWS OF THE DRAWINGS

FIG. 2 is a rear view of the back of the embodiment of FIG. 1 after it has been folded and bonded except for its top flap.

FIG. 3 is a front view of the front of the embodiment of FIG. 1 after it has been folded and bonded except for its top flap.

FIGS. 4 and 5 are plan views similar to FIG. 1 but showing the preferred dimensions of the preferred embodiment of the invention illustrated in FIG. 1.

FIGS. 6 and 7 are plan views similar to FIGS. 2 and 3 but showing the preferred dimensions of the preferred embodiment of the invention illustrated in FIG. 1.

Figure 1:
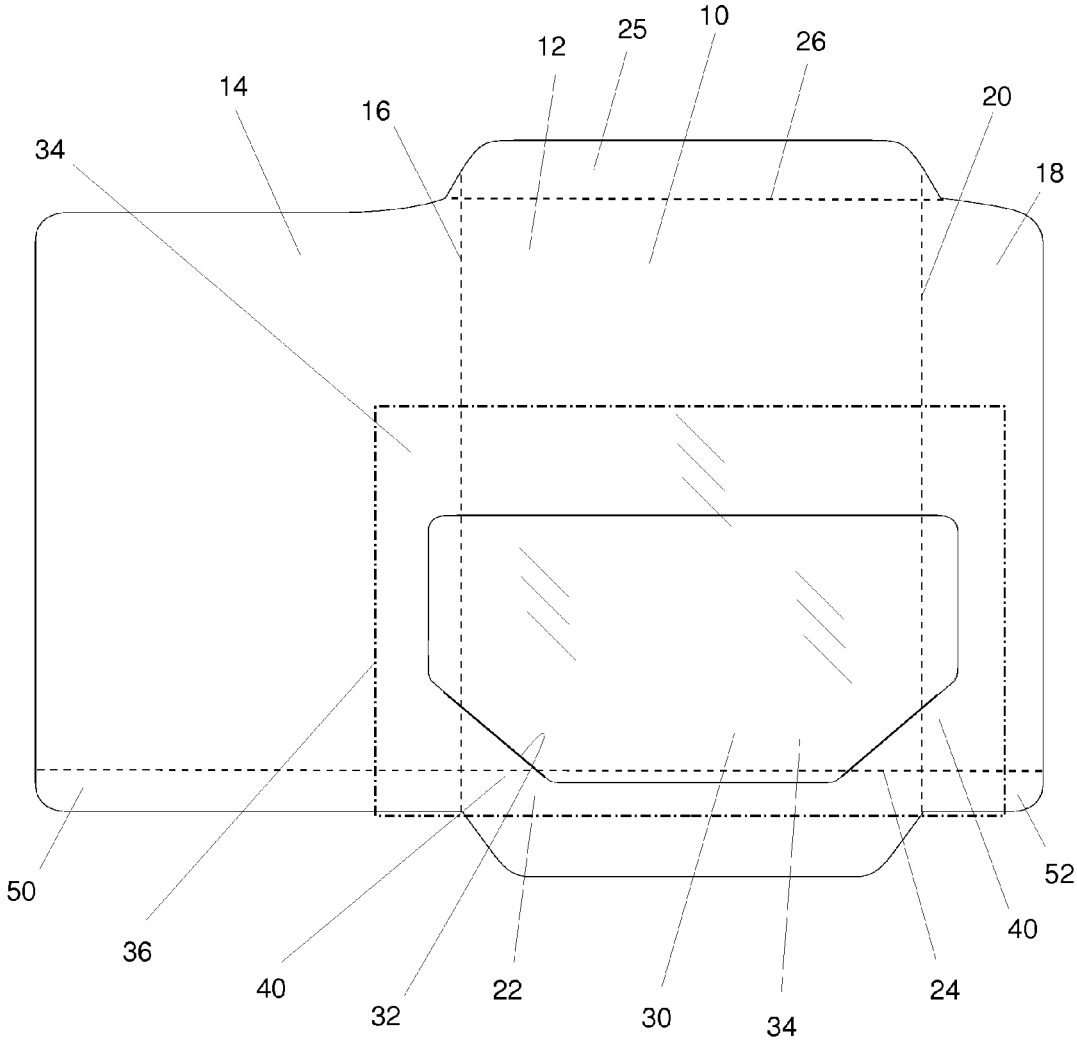
FIG. 1 is a plan view of an envelope blank that is the preferred embodiment of the invention but is shown unfolded and unbonded except for the bonding of a sheet of window material in place on a sheet of envelope material.

In describing the preferred embodiment of the invention which is illustrated in the drawings, specific terminology will be resorted to for the sake of clarity. However, it is not intended that the invention be limited to the specific term so selected and it is to be understood that each specific term includes all technical equivalents which operate in a similar manner to accomplish a similar purpose.

DETAILED DESCRIPTION OF THE INVENTION

Referring to FIGS. 1-3, the preferred embodiment of the invention includes some fundamental envelope component structures that are known to those skilled in the art. In that respect, the seed pack envelope is formed principally of a sheet 10 of envelope material of the kind commonly used for forming seed pack envelopes, most commonly a paper. The seed pack is initially formed as a blank that comprises several panels that are attached together and later folded into the envelope. There is a panel or flap attached to each of the four sides of the front panel. The panels are joined together along conventional score lines that facilitate later folding of the panels along the score lines to form creases that become the edges of the sealed envelope. Consequently, score lines, creases and edges ordinarily occur together at the same places. The particular choice among these terms ordinarily reflects the stage of manufacture of the envelope or the characteristic that is most relevant to a particular discussion. In FIG. 1, the terminal boundary of the sheet 10 of envelope material is shown in solid black lines. The fold lines, creases and scores are shown with dashed lines and the peripheral boundary of a sheet of window material, is shown by phantom lines; that is, alternating dots and dashes.

The envelope has a front panel 12 and a back first panel 14 connected to the front panel 12 along a first fold crease 16 at a first edge of the front panel 12. A side second panel 18 is connected to the front panel 12 along a second fold crease 20 at a second edge of the front panel 12. A side third panel 22 is connected to the front panel 12 along a third fold crease 24 at a third edge of the front panel 12. To assemble the envelope, the back first panel 14 is folded back onto the front panel 12. The side second panel 18 and the side third panel 22 are bonded to the back first panel 14 to form the envelope. Two of the fold creases 16 and 20 are laterally opposite fold creases along laterally opposite side edges of the envelope. As illustrated and is customary, the back panel 14 is considerably larger than the other two side panels because it extends nearly or completely across the back of the envelope. The back panel 14 may be connected along scored fold creases to the front panel along either the left or the right lateral side of the envelope or along the bottom of the envelope. There is also a top flap 25 which is ordinarily also folded along a score line 26 and is usually the structure by which the purchaser gains access to the contents of the envelope.

In the invention, an aperture 30 is cut through the sheet 10 of envelope material for forming a window and has an outer peripheral boundary 32. The aperture 30 extends not only through and entirely across the front panel 12 from one of the laterally opposite fold creases 16 to the other laterally opposite fold crease 20, but also further extends beyond the laterally opposite fold creases 16 and 20 into the side panels 14 and 18 that are connected to the front panel 12 along the laterally opposite fold creases 16 and 20. Preferably, the aperture 30 extends beyond the laterally opposite fold creases 16 and 20 and into the panels 14 and 18 by a distance in the range of 3/32" to 11/32".

A transparent sheet 34 of window material, having a rectangular peripheral boundary 36, extends beyond the aperture 30 (i.e. beyond the peripheral boundary 32 of the aperture 30) so as to overlap the sheet 10 of envelope material in a peripheral overlap area around the aperture. This peripheral overlap area is the area between the peripheral boundary 32 of the aperture and the peripheral boundary 36 of the transparent sheet 34. The transparent sheet 34 has a width greater than the distance between the laterally opposite side edges and is folded along the laterally opposite side edges 16 and 20 when the blank of FIG. 1 is folded and assembled into the envelope of FIGS. 2 and 3. The transparent sheet 34 is bonded to at least the front panel 12 and the panels 14 and 18 that are connected to the front panel 12 along the laterally opposite fold creases 16 and 20. The bonding of the transparent sheet 34 occurs at the peripheral overlap area although it is not necessary that the entire overlap area be bonded.

One of the fold creases, in the preferred embodiment the fold crease 24, extends along a bottom of the envelope and joins the laterally opposite side edges 16 and 20. The aperture 30 should extend at least to the fold crease 24 along a bottom of the envelope. The transparent sheet 34 is folded along the bottom fold crease 24 and is bonded to the panel 22 that is connected to the front panel 12 along the fold crease 24 that is along the bottom of the front panel 12.

Preferably, the aperture 30 also extends beyond the bottom fold crease 24 and into the panel 22 that is connected to the front panel 12 along the bottom fold crease 24 so that a portion of the contents of the envelope is visible from the back of the envelope adjacent the bottom fold crease 24. Preferably, the aperture 30 extends beyond the bottom fold crease 24 and into the panel 22 by a distance in the range of 1/32" to 3/32".

The strength of a seed pack envelope at its bottom two corners is very important for the reasons described above. However, the problem of corner strength becomes considerably more difficult when the window aperture extends beyond the laterally opposite side creases and the bottom crease. The problem is how to form the structures so that the window extends around the laterally opposite side edges and the bottom edge and yet at the same time the envelope not only will be strong enough to resist tearing from seed forces but also will be stiff enough to not excessively sag and spread at its bottom and instead stand straight upright in a display rack pocket with other parallel, filled seed envelopes.

One of the ways the invention increases the corner strength is to form the corners of the aperture 30 with triangular gussets 40 formed in the sheet 10 of envelope material at the laterally opposite sides of the aperture 30. The gussets 40 extend across a portion of the front panel 12 at the bottom corners of the envelope. However, in addition to a portion of the gussets 40 being a part of the front panel 12, the gussets 40 extend further to beyond the laterally opposite side edges 16 and 20. The gussets 40 extend all the way to laterally opposite sides of the aperture 30 and to the bottom of the aperture 30. With this configuration, the fold creases 16, 20 and 24 extend through the gussets 40 so that each gusset 40 is folded in two places when the envelope is assembled. Each fold improves the rigidity of the gussets. Therefore, a portion of the gussets 40 are also a part of the back of the assembled envelope. Preferably, the portion of each gusset that is formed in the front panel is triangular and has a height and a width (i.e. the legs of the right triangle) that are in the range of ⅜" to ⅞" (i.e. along the fold edges 16, 20 and 24). The left gusset triangular portion that is a part of the front panel is bounded by the fold crease 16, the fold crease 24 and the window boundary 32. The right gusset triangular portion that is a part of the front panel is bounded by the fold crease 20, the fold crease 24 and the window boundary 32.

In order to additionally strengthen the bottom two corners of a seed pack envelope embodying the invention, the panels 14 and 18, that are connected to the front panel 12 along creases 16 and 20, each have a lower portion, 50 and 52 respectively, extending beyond the bottom fold crease 24. In FIG. 1, the lower portion 50 is the portion of the back panel 14 that lies below the fold crease 24 and to the left of the side fold crease 16. The lower portion 52 of the panel 18 is below the fold crease 24 and to the right of the fold crease 20. These lower portions 50 and 52 are integrally connected to the panel 22 that is connected to the front panel 12 along the bottom fold crease 24. When the envelope is assembled, the two lower portions 50 and 52 and the panel 22 are all folded along the bottom fold crease 24.

The transparent sheet 30 of window material is bonded to the two lower portions 50 and 52 adjacent the bottom two corners, to the gussets 40 and to the bottom panel 22. Therefore, referring to FIG. 1, in the regions of the envelope blank surrounding the bottom two corners, the blank is essentially a two-layer laminate of paper envelope sheet material and plastic window material.

The blank may be assembled by first folding the side panel 18 onto the front panel 12, then folding the side panel (back) 14 onto the side panel 18 and bonding them together, and then folding and bonding the side panel 22 (bottom) onto the panels 14 and 18. The result is that the bottom corners of the envelope are formed by bonded laminations of envelope material and window material. Specifically, each bottom corner has four two-layer laminated layers for a total of eight layers in each corner, four paper layers and four plastic layers. One of the two-layer laminate layers is at the gussets forming a part of the front panel 12 and the other six layers are bonded as part of the back of the envelope.

The use of the extended and laminated lower portions 50 and 52 and the gussets 40 increases the vertical strength and integrity of the envelope, especially at the bottom corners of the envelope. This increased strength and integrity means that the corners have considerably more resistance to tearing and therefore reduces seed loss by leakage from the envelope despite the existence of the wrap around window. The strength and rigidity added by these structural features improve the ability of the envelope to stand up vertically in display racks or cases with less spreading of the front and back walls of the envelope that increases the thickness at the bottom of the envelope and results in lowering its height. Otherwise, spreading and thickening of the bottom of the envelope causes the seed level or seed height to be reduced making less seed visible and therefore making it appear that there is not as much seed product.

FIGS. 4-7 show the dimensions of the preferred embodiment of the invention. The wrap around window has a height sufficient to permit viewing of the contained seed all the way to the top seed mass and extends all the way to the bottom so that the bottom of the seed mass may be viewed. This allows the entire height of the seed mass to be viewed. By additionally extending the window around the side edges and onto the back of the envelope, both the entire width and the thickness of the seed mass may also be viewed. Consequently, the envelope of the invention is the first to permit a three dimensional view of the seed contents.

This detailed description in connection with the drawings is intended principally as a description of the presently preferred embodiments of the invention, and is not intended to represent the only form in which the present invention may be constructed or utilized. The description sets forth the designs, functions, means, and methods of implementing the invention in connection with the illustrated embodiments. It is to be understood, however, that the same or equivalent functions and features may be accomplished by different embodiments that are also intended to be encompassed within the spirit and scope of the invention and that various modifications may be adopted without departing from the invention or scope of the following claims.

The invention claimed is:

1. An improved, seed pack envelope formed of a sheet of envelope material having a front panel, a back first panel connected to the front panel along a first fold crease at a first edge of the front panel, a side second panel connected to the front panel along a second fold crease at a second edge of the front panel and a side third panel connected to the front panel along a third bottom fold crease at a third edge of the front panel, the back first panel being folded back 180° onto the front panel and the side second and third panels being folded back 180° and bonded to the back first panel to form the envelope, two of the fold creases being laterally opposite fold creases along laterally opposite side edges of the envelope, wherein the improvement comprises:

(a) an aperture extending not only through and entirely across the front panel from one of the laterally opposite fold creases to the other laterally opposite fold crease but also further extending beyond the laterally opposite fold creases into the panels that are connected to the front panel along the laterally opposite fold creases;

(b) a transparent sheet of window material extending beyond the aperture so as to overlap the sheet of envelope material in a peripheral overlap area around the aperture, the transparent sheet having a width greater than the distance between the laterally opposite side edges and folded along the laterally opposite side edges, the transparent sheet being bonded at the peripheral overlap area to at least the front panel and the panels that are connected to the front panel along the laterally opposite fold creases, the portion of the transparent sheet of window material that extends across the front panel being folded 180° and lying against the portion of the transparent sheet of window material that extends across the panels that are connected to the front panel along the fold creases;

(c) the panels (14, 18), that are connected to the front panel (12) along creases (16, 20) that are along the laterally opposite side edges, having a lower portion (50, 52) extending beyond the bottom fold crease (24) and integrally connected to the panel (22) that is connected to the front panel (12) along the bottom fold crease (24) so that lower portions (50, 22, 52) of all three panels that are connected to the front panel (12) are folded 180° along the bottom fold crease (24);

(d) the aperture having gussets (40) formed in the sheet of envelope material at the opposite ends of the bottom fold crease, the gussets (40) extending across a portion of the front panel at bottom corners of the envelope and beyond the laterally opposite side edges to laterally opposite sides of the aperture; and (e) the transparent sheet of window material (34) extending at least from the aperture onto, and bonded to, all three lower portions (50, 22, 52) and to the gussets (40) so that the bottom corners of the envelope are formed by four two-layer laminated layers of envelope material and window material.

2. A seed pack envelope in accordance with claim 1 wherein the aperture extends beyond the bottom fold crease and into the panel that is connected to the front panel along the bottom fold crease so that a portion of the contents of the envelope is visible from the back of the envelope adjacent the bottom fold crease.

3. A seed pack envelope in accordance with claim 2 wherein the portion of each gusset formed in the front panel is triangular and has a height and a width that are in the range of ⅜" to ⅞".

4. A seed pack envelope in accordance with claim 2 wherein the aperture extends beyond the laterally opposite fold creases and into the panels that are connected to the front panel along the laterally opposite fold creases by a distance in the range of 3/32" to 11/32".

5. A seed pack envelope in accordance with claim 4 wherein the aperture extends beyond the bottom fold crease and into the panel that is connected to the front panel along the bottom fold crease by a distance in the range of 1/32" to 3/32".

6. A seed pack envelope in accordance with claim 2 wherein the back first panel is connected to the front panel along one of the laterally opposite side edges.

* * * * *